US012408751B2

(12) United States Patent
Ill

(10) Patent No.: US 12,408,751 B2
(45) Date of Patent: Sep. 9, 2025

(54) PULL-OUT GUIDE

(71) Applicant: FULTERER AG & CO KG, Lustenau (AT)

(72) Inventor: Bernhard Ill, Hohenweiler (AT)

(73) Assignee: FULTERER AG & CO KG, Lustenau (AT)

( * ) Notice: Subject to any disclaimer, the term of this patent is extended or adjusted under 35 U.S.C. 154(b) by 270 days.

(21) Appl. No.: 18/030,898

(22) PCT Filed: Sep. 20, 2021

(86) PCT No.: PCT/EP2021/075826
§ 371 (c)(1),
(2) Date: Apr. 7, 2023

(87) PCT Pub. No.: WO2022/089838
PCT Pub. Date: May 5, 2022

(65) Prior Publication Data

US 2023/0380592 A1 Nov. 30, 2023

(30) Foreign Application Priority Data

Oct. 28, 2020 (AT) ..... 243/2020

(51) Int. Cl.
*A47B 88/447* (2017.01)
*A47B 88/423* (2017.01)
(Continued)

(52) U.S. Cl.
CPC ..... *A47B 88/447* (2017.01); *A47B 88/423* (2017.01); *A47B 88/477* (2017.01);
(Continued)

(58) Field of Classification Search
CPC ..... A47B 88/57; A47B 88/423; A47B 88/493; A47B 88/477; A47B 2088/4235;
(Continued)

(56) References Cited

U.S. PATENT DOCUMENTS 3,123,419 A * 3/1964 Maxwell ..... A47B 88/493 312/334.13
3,259,447 A * 7/1966 Deutsch ..... A47B 88/57 312/334.46
(Continued)

FOREIGN PATENT DOCUMENTS

DE 40 05 406 A1 9/1990
DE 4005405 A1 * 10/1990 ..... A47B 88/493
(Continued)

OTHER PUBLICATIONS

International Search Report with translation and Written Opinion for PCT application No. PCT/EP2021/075826, mailed Jan. 20, 2022.
International Application Status Report generated Mar. 14, 2023.

*Primary Examiner* — Hiwot E Tefera
(74) *Attorney, Agent, or Firm* — Notaro, Michalos & Zaccaria P.C.

(57) ABSTRACT

A pull-out guide for pulling out an extractable furniture part from a furniture carcass has a first rail and a second rail. Pulling first rail out of the second rail is limited by a stop element of the first rail striking a pull-out stop of the second rail. A securing part mounted on the second rail is rotatable about an axis of rotation. The securing part can be rotated, counter to the force of a spring element, from a blocked position, in which lifting of the front end of the first rail is blocked, in a rotational opening direction into a release position, in which the front end of the first rail can be lifted and the stop element of the first rail can be moved over the pull-out stop of the second rail. A holding device, in a holding state, holds the securing part in the release position.

14 Claims, 6 Drawing Sheets

(51) Int. Cl.
*A47B 88/477* (2017.01)
*A47B 88/493* (2017.01)
*A47B 88/57* (2017.01)

(52) U.S. Cl.
CPC ..... *A47B 88/493* (2017.01); *A47B 88/57* (2017.01); *A47B 2088/4235* (2017.01)

(58) Field of Classification Search
CPC ..... A47B 88/447; A47B 2210/0043; A47B 88/487; A47B 2210/0081; A47B 88/437
See application file for complete search history.

(56) References Cited

U.S. PATENT DOCUMENTS 4,065,196 A * 12/1977 Stein ..... A47B 88/57 384/19
4,765,699 A * 8/1988 Bessinger ..... A47B 88/57 312/334.46
5,255,983 A * 10/1993 Parvin ..... A47B 88/57 312/333
5,433,517 A * 7/1995 Fleisch ..... A47B 88/493 312/334.46
5,484,197 A * 1/1996 Hansen ..... A47B 88/493 384/19
6,367,899 B1 * 4/2002 Hwang ..... A47B 88/57 312/334.47
6,412,891 B1 * 7/2002 Liang ..... A47B 88/487 312/334.44
2008/0034662 A1 * 2/2008 Peng ..... A47B 88/57 49/175
2009/0195133 A1 * 8/2009 Chang ..... A47B 88/493 312/334.46
2017/0208942 A1 * 7/2017 Chen ..... A47B 88/43
2018/0092462 A1 * 4/2018 Chen ..... A47B 88/493
2018/0288897 A1 * 10/2018 Yoneda ..... F16C 29/02
2019/0200756 A1 * 7/2019 Chen ..... A47B 88/473
2023/0404259 A1 * 12/2023 Ill ..... A47B 88/423

FOREIGN PATENT DOCUMENTS

DE 4210017 A1 * 10/1992 ..... A47B 88/57
EP 1 795 088 A1 6/2007
EP 2992780 A1 3/2016
GB 202 562 A 8/1923
GB 1335776 A 10/1973

* cited by examiner

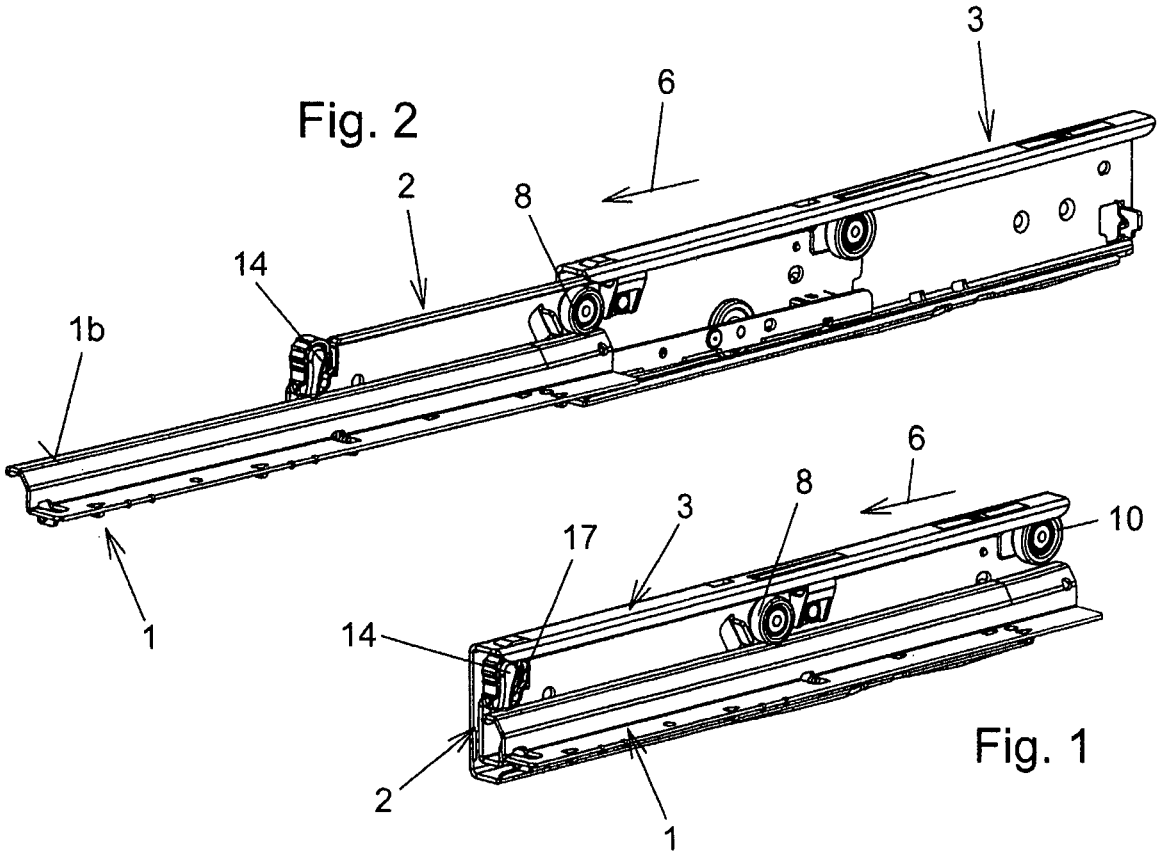
Fig. 2
Fig. 1
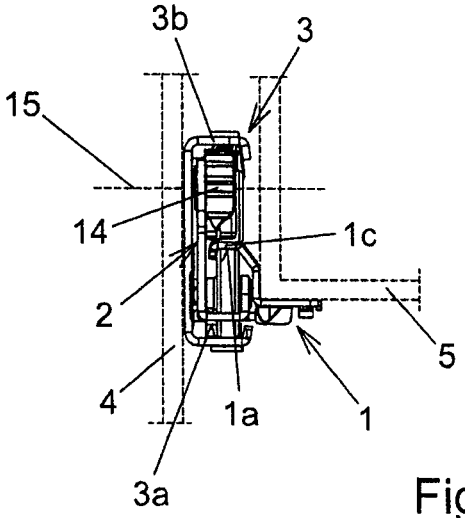
Fig. 3

PULL-OUT GUIDE

The invention relates to a pull-out guide for pulling out an extractable furniture part from a furniture carcass, comprising a first rail and a second rail, wherein the first rail can be pulled out from the second rail in a pull-out direction starting from an inserted position into an extracted position in which a further pulling out of the first rail from the second rail is delimited by a stop element of the first rail striking a pull-out stop of the second rail, and wherein a securing part is mounted on the second rail so as to be rotatable about an axis of rotation, which securing part can be twisted counter to the force of a spring element from a blocked position in which a lifting of the front end of the first rail is blocked, in an opening direction of rotation into a release position in which, for complete removal of the first rail from the second rail starting from the extracted position of the first rail, the front end of the first rail can be lifted and the stop element of the first rail can be moved over the pull-out stop of the second rail.

Pull-out guides of the type mentioned initially are deduced from GB 1 335 776 B and GB 801 255 B. These pull-out guides comprise a first rail in the form of a pull-out rail or loading rail, a second rail in the form of a middle rail and a third rail in the form of a carcass rail and is configured as a differential pull-out guide with a load-transmitting differential roller mounted rotatably in a central region of the middle rail. When pulling out the pull-out rail from the middle rail, this pulling out is delimited by a stop element of the pull-out rail striking against a pull-out stop of the middle rail. If the pull-out rail is to be removed completely from the middle rail, a securing part mounted rotatably on the middle rail is twisted against the force of a spring element from a blocked position into a release position. In the blocked position, the securing element blocks any lifting of a front end of the pull-out rail. In the release position the front end of the pull-out rail can be raised and the stop element of the pull-out rail can thereby be guided over the pull-out stop of the middle rail and the pull-out rail removed from the middle rail. Conversely, the pull-out rail can be inserted into the middle rail, for example, when assembling the pull-out guide. A disadvantage here consists in that in order to insert a drawer on which left and right pull-out guides are mounted, the securing parts of both middle rails must be adjusted simultaneously against the force of the spring element into the release position and the drawer must be inserted in these positions of the securing elements which can only be accomplished with some difficulty by one person. The same applies to the removal of the drawer with the pull-out guides mounted thereon from the middle rails.

A similar pull-out guide is also deduced from GB 202,562 A. Here however, the securing part is not urged into the blocked position by a spring element but is held in a frictionally engaged manner in the current rotational position about the axis of rotation. During closure of the drawer the faceplate of the drawer approaches the securing part and adjusts this into the blocked position. For this purpose, however, the faceplate of the drawer and the middle rail must be mounted in precisely the correct relationship to one another, otherwise the securing part will not be correctly adjusted into the blocked position when closing the drawer. In practice, however, such a precise relationship is not easy to adhere to when mounting the pull-out guide on the drawer. For example, in the case of refrigeration furniture with thick sealing lips, there is also the problem here that the pull-out guide (with self-closing mechanism) compresses the sealing lips variously strongly depending on the loading and thus different end positions are present.

Similar applies to the pull-out guide known from EP 1 795 088 A1. Here the securing part can be twisted and displaced with respect to a kingpin. When the faceplate of the drawer approaches the securing part during closure of the drawer, this displaces the securing part with respect to the kingpin with the result that a shoulder of the securing part and the retaining surface of the middle rail engage and the securing part is blocked from any twisting about the axis of rotation.

Also in the pull-out guide known from GB 345,539 B the securing part can be pivoted and displaced about an axle pin. When the pull-out guide is closed in the release position of the securing part, the securing part approaches a flange of the carcass rail and is thereby pivoted about the axis of rotation into the blocked position and displaced with respect to the axis of rotation so that a pin attached to the middle rail is inserted into a recess of the securing part and the securing part is blocked from any rotation about the axis of rotation. If as a result of the mounting of the pull-out guide on the drawer, the faceplate of the drawer strikes the furniture carcass before the pull-out rail is completely inserted in the middle rail, blocking of the securing part against any rotation about the axis of rotation is not achieved.

CH 679735 A5 and U.S. Pat. No. 4,065,196 A disclose pull-out guides in which the pull-out stop of the middle rail is itself pivotable in order that the stop element of the pull-out rail can move past the pull-out stop of the middle rail.

It is the object of the invention to provide an advantageous pull-out guide of the type mentioned initially which is characterized by easy operation and reliable function. According to the invention, this is achieved by a pull-out guide having the features of Claim 1.

In the pull-out guide according to the invention, on the one hand, a spring element is provided against the force of which the securing part can be twisted from the blocked position into the release position and on the other hand, a holding device is provided which, in a holding state, holds the securing part twisted into the release position in the release position. By means of the holding device, a fixing of the securing part in the release position can be achieved when the first rail is to be completely separated from the second rail or when the first rail separated from the second rail is to be inserted in the second rail. The removal and insertion of the first rail can thus be achieved in a simple manner, for example, during mounting of the pull-out guide on a piece of furniture. When the holding device is released, a reliable adjustment of the securing part into the blocked position can be achieved by the spring element.

Advantageously during twisting of the securing part from the blocked position into the release position, the holding device automatically adopts the holding state. An additional actuation of the holding device by the user in order to activate the holding state of the holding device is therefore not necessary.

Preferably the holding device is configured as a snap connection. In this case, the securing part can have an elastic tongue which has a locking tab which, in the holding state of the holding device, cooperates with a retaining surface disposed on the second rail. This retaining surface can, for example, be formed by the front end of an upper horizontal web of the second rail. In order to release the holding state of the holding device, in this configuration, for example, the user can actuate the elastic tongue in order to bring the locking tab out of engagement with the retaining surface. Advantageously however, it can also be provided that the release of the holding device takes place automatically when the first rail is inserted into the second rail and/or in the event of an actuation of the pull-out guide.

In an advantageous embodiment of the invention, in addition to the first and second rail the pull-out guide has a third rail from which the second rail can be pulled out and into which the second rail can be inserted. The second rail is therefore disposed between the first and third rail. The third rail can be attached to a furniture carcass and the first rail to an extractable furniture part. The third rail could also be designated as carcass rail, the second rail as middle rail and the first rail as pull-out rail (or also loading rail). In particular, in such a configuration it is provided that during movement of the first rail with respect to the second rail the second rail moves synchronously with respect to the third rail. Such pull-out guides are also designated as synchronous pull-outs or differential pull-outs. Favourably in this case, in a central region of its longitudinal extension, the second rail has a rotatably mounted load-transmitting differential roller which has some play in the vertical direction with respect to the second rail and rolls between a track of the first rail and a track of the third rail. Such differential pull-out guides are fundamentally known. Advantageously here all the rollers are disposed on the middle rail.

When there is talk of "front" and "rear" in this document, this is related to the pull-out direction.

Further advantages and details of the invention are explained hereinafter with reference to the appended drawings. In the figures:

FIG. 1 shows an oblique view of an exemplary embodiment of a pull-out guide according to the invention in the closed position of the pull-out guide;

FIG. 2 shows an oblique view similar to FIG. 1 in the open position of the pull-out guide;

FIG. 3 shows a front-side view of the pull-out guide, wherein parts of a furniture carcass and an extractable furniture part are indicated by dashed lines;

Figure 4:
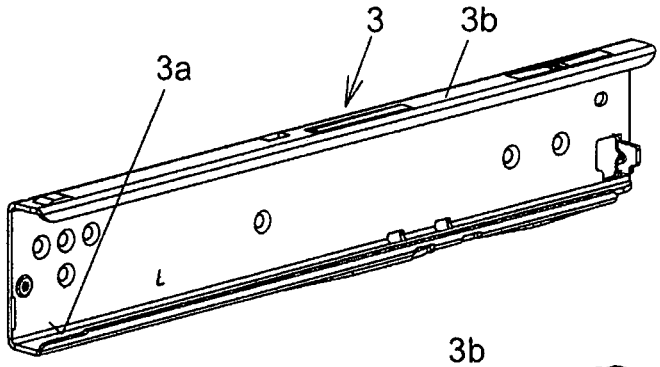
FIGS. 4 and 5 show oblique views of the third rail from different viewing directions.
Figure 5:
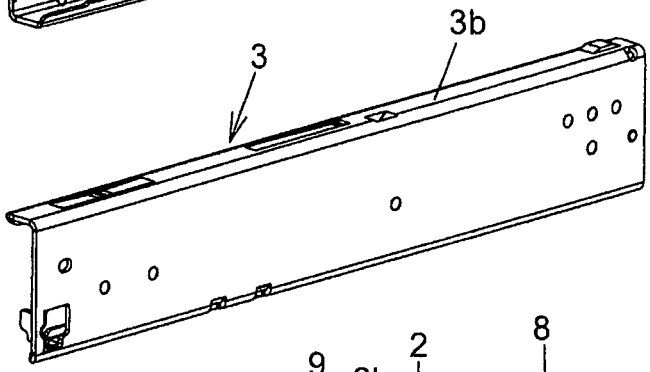
Figure 6:
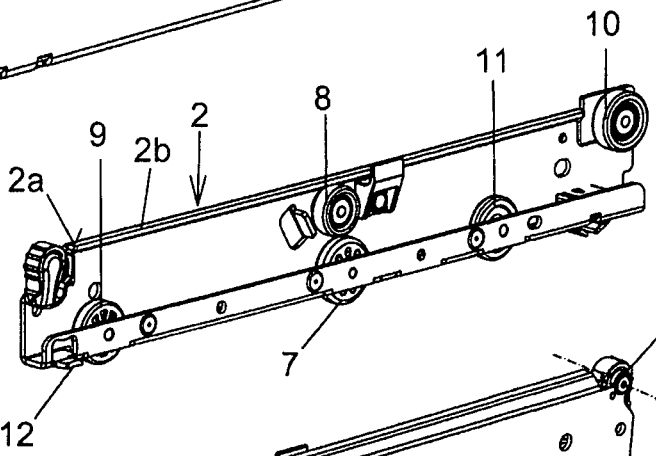
FIGS. 6 and 7 show oblique views of the second rail from different viewing directions.
Figure 7:
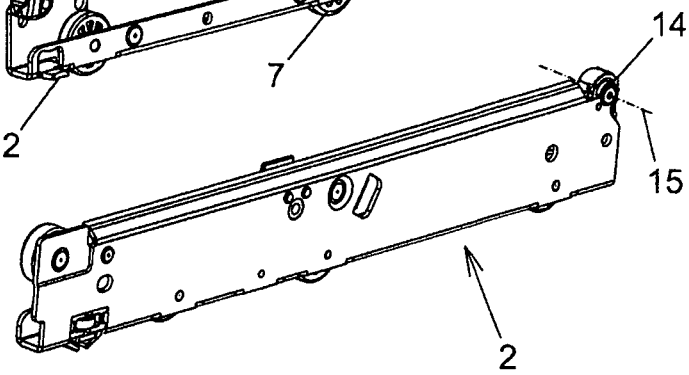
Figure 8:
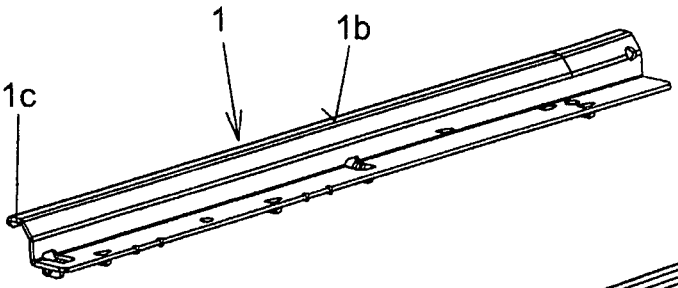
FIGS. 8 and 9 show oblique views of the first rail from different viewing directions.
Figure 9:
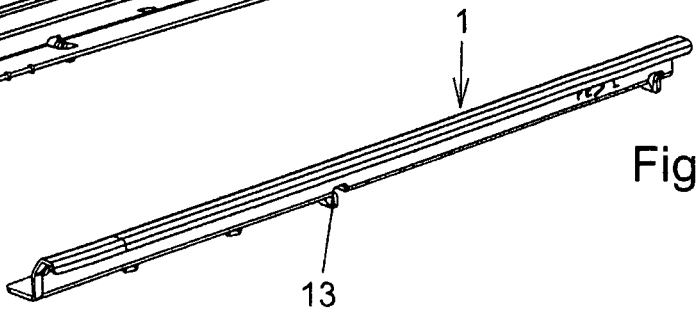
Figure 10:
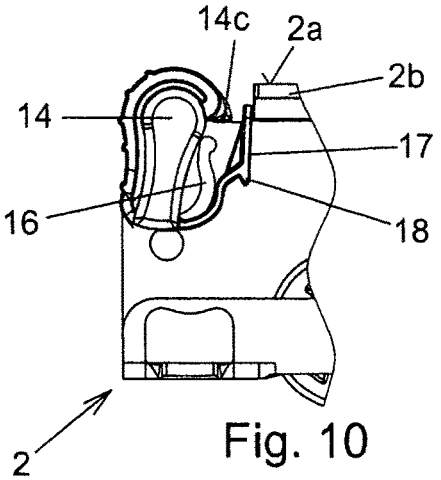
FIG. 10 shows an enlarged section of a front section of the second rail in side view (at right angles to the pull-out direction) in the blocked position of the securing part.
Figure 11:
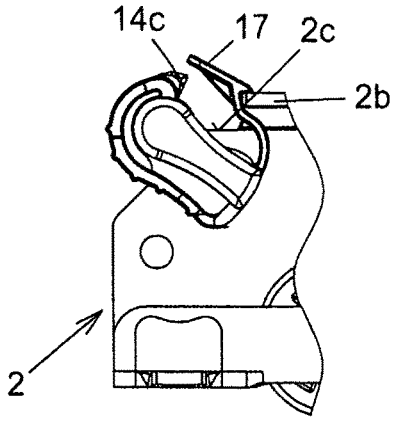
FIG. 11 shows a diagram similar to FIG. 10 in the release position of the securing part.
Figure 12:
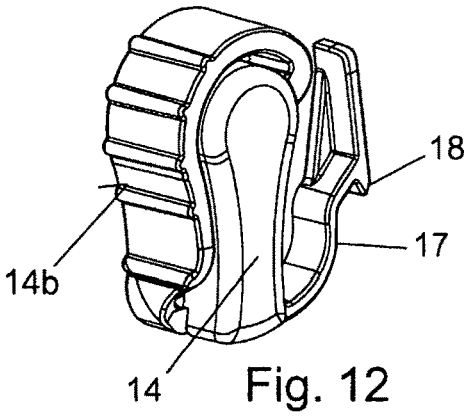
FIGS. 12, 13 and 14 show oblique views of the securing part from different viewing directions.
Figure 13:
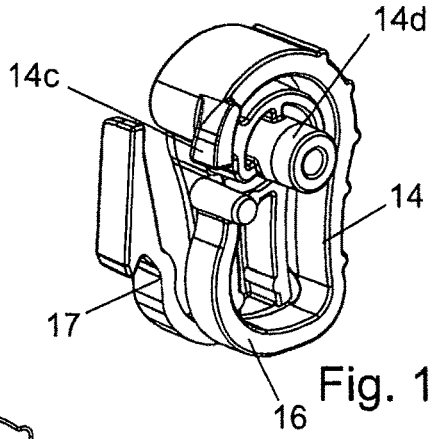

An exemplary embodiment of a pull-out guide according to the invention is explained hereinafter with reference to FIGS. 1 to 28. The pull-out guide is configured as a roller pull-out. In a roller guide, rollers which bring about the mutual displaceable guidance of the rails are rotatably mounted on the rails. The pull-out guide comprises a first rail 1, a second rail 2 and a third rail 3 wherein in the exemplary embodiment all the rollers are rotatably mounted on the second rail. The third rail 3 is used for attachment to a furniture carcass 4 of which only a section is indicated by dashed lines in FIG. 3. The first rail 1 is used for attachment to an extractable furniture part 5, for example, a drawer of which only a section is indicated by dashed lines in FIG. 3. The third rail 3 could also be designated as carcass rail, the second rail 2 as middle rail and the first rail 1 as pull-out rail.

The rails 1-3 are guided synchronously, i.e. during extraction of the first rail 1 from the second rail 2 in a pull-out direction 6, the second rail 2 is displaced synchronously with respect to the third rail 3 in the pull-out direction 6. In this case, with respect to the third rail 3 the second rail 2 covers half the distance of the first rail 1 in each case.

A differential roller arranged rotatably on the second rail 2 in the central region of its longitudinal extension is used for synchronous guidance of the rails 1 to 3, which roller rolls between a downwardly directed track 1*a* of the first rail 1 arranged on the underside of a horizontal web 1*c* and an upwardly directed track 3*a* of the third rail 3 arranged on the upper side of a lower horizontal web and hereby transfers a part of the load of the first rail 1 directly onto the third rail 3. The differential roller 7 here has some play in the vertical direction. Such pull-outs are also known as "differential pull-outs".

Located in a central region of the longitudinal extension of the second rail 2 above the differential roller 7, in the exemplary embodiment somewhat offset towards the front with respect to the differential roller 7 is a support roller 8 which can support the rear end of the first rail 1 in the extracted position of the first rail 1 in the upward direction.

In the exemplary embodiment, as already mentioned, all the rollers are arranged on the middle rail as is preferred in differential pull-out guides. In particular, a roller 9 cooperating with the same upwardly directed track 3*a* of the third rail 3 as the differential roller 7 is located in the region of the front end of the second rail 2 and a roller 10 cooperating with a downwardly directed track of the third rail 3 arranged on the underside of an upper horizontal web 3*b* is located in a rear region of second rail 2. An auxiliary roller 11 which supports the rear end of the first rail 1 in the inserted position of the first rail 1 in the downward direction is preferably rotatably mounted in the region between the differential roller 7 and the rear end of the second rail 2.

A pull-out stop 12 of the second rail 2 which a stop element 13 of the first rail approaches in the extracted position of the first rail 1 is used to delimit the pulling out of the first rail 1 with respect to the second rail 2 in the extracted position of the first rail 1. Furthermore a securing part 14 is arranged on the second rail 2 which will be explained in detail hereinafter and which, in a blocked position, prevents the front end of the first rail 1 from being able to be raised (apart from a certain play) and the stop element 13 from being able to be moved over the pull-out stop 12.

The pulling out of the second rail 2 with respect to the third rail 3 and the insertion of the first rail 1 into the second rail 2 and of the second rail 2 into the third rail 3 are also delimited by stops which can be configured according to the prior art and are not explained in detail at this point.

In the closed position of the pull-out guide the first rail 1 has its inserted position in which it is completely inserted into the second rail 2 and the second rail 2 has the inserted position in which it is completely inserted into the third rail 3. In the open position of the pull-out guide the first rail 1 has its extracted position in which it is completely extracted from the second rail 2 and the second rail 2 has its extracted position in which it is completely extracted from the third rail 3.

The securing part 14 is mounted in the region of the front end of the second rail 2 on a base part of the second rail 2 (which in particular is configured as a metal profile) so as to be rotatable about an axis of rotation 15 at right angles to the pull-out direction 6. In the blocked position of the securing part 14, which is shown in FIGS. 1, 2, 6, 7, 10, 17, 18 and 26, a lifting of the front end of the first rail 1 is blocked by the securing part 14 (apart from some play) whereby a contact surface 14*a* of the securing part 14 cooperates with a support surface 1*b* of the first rail 1. In the exemplary embodiment the support surface 1*b* of the first rail 1 is formed by the upper side of a horizontal web 1*c* of the first rail 1. In particular, the upper side of this horizontal web 1*c* forms the track for cooperation with the support roller 8 and the underside of this horizontal web 1*c* forms the track 1*a* for cooperation with the differential roller 7.

In a side view seen in a direction parallel to the axis of rotation 15 (cf. in particular FIGS. 14 and 15), the securing part 14 has an external contour which in the region of the contact surface 14*a* has a greater distance a from the axis of rotation 15 than in regions adjacent to the contact surface 14*a*. It could also be said that the securing part 14 is mounted eccentrically so as to be rotatable about the axis of rotation 15.

If the securing part 14, starting from the blocked position, is twisted in an opening direction of rotation in the direction of the release position about the axis of rotation 15, this twisting is accomplished against the retaining force of a spring element 16. In the exemplary embodiment, the spring element 16 is formed in one part, in particular in one piece of material with the securing part 14. In this case, the spring element 16 is formed by a band-shaped portion of the securing part 14 which runs in a curved manner, wherein the securing element 14, at least in this section, consists of an elastic material, in particular elastic plastic. The spring element 16 therefore starts from a main part of the securing part 14 and is released with respect to this. The end of the spring element 16 remote from the main part of the securing element 14 is supported on the second rail 2, for example, whereby a pin-shaped projection of the spring element 16 engages in a bore in the second rail 2.

The securing part 14 and the spring element 16 can also comprise different materials, even in a one-piece material configuration. The spring element 16 could thus, comprise a plastic, for example, that differs from the securing part and/or a spring element could be injection-moulded from metal.

If the securing part 14 is twisted about the axis of rotation 15 starting from the blocked position into the release position, a snap connection between the securing part 14 and the second rail 2 is automatically closed, which the securing part 14 holds against the force of the spring element 16 in the release position. The release position of the securing part 14 can be seen from FIGS. 11, 19, 20, 21, 23, 27 and 28. The snap connection thus forms a holding device wherein in the closed state of the snap connection the holding device has a holding state and in this state holds the securing part 14 twisted into the release position in the release position. When twisting the securing part 14 from the blocked position into the release position, the holding state is automatically adopted by the holding device.

In order to form the snap connection, in the exemplary embodiment the securing part 14 has an elastic tongue 17 which has a locking tab 18. In the closed state of the snap connection the locking tab 18 is snapped into the second rail 2 (directly into the main part of the second rail configured as a metal profile or into a part connected to this) and cooperates with a retaining surface 2*a* of the second rail 2. In the exemplary embodiment the locking tab 18 is snapped into the front end of an upper horizontal web 2*b* of the second rail 2 and the retaining surface 2*a* is formed in the region of the upper side of the front end of the upper horizontal web 2*b*. This upper horizontal web 2*b* is a section of a main part which in particular is a metal profile, of the second rail 2. Instead, a connecting part could also be disposed on the main part, in particular metal profile, of the second rail 2, with which the locking tab 18 of the tongue 17 of the securing part 16 cooperates.

Figure 17:
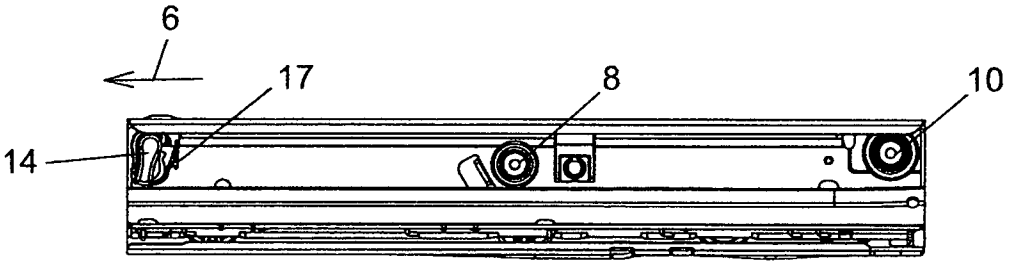
FIG. 17 shows the pull-out guide in the closed position in side view (at right angles to the pull-out direction)
Figure 18:
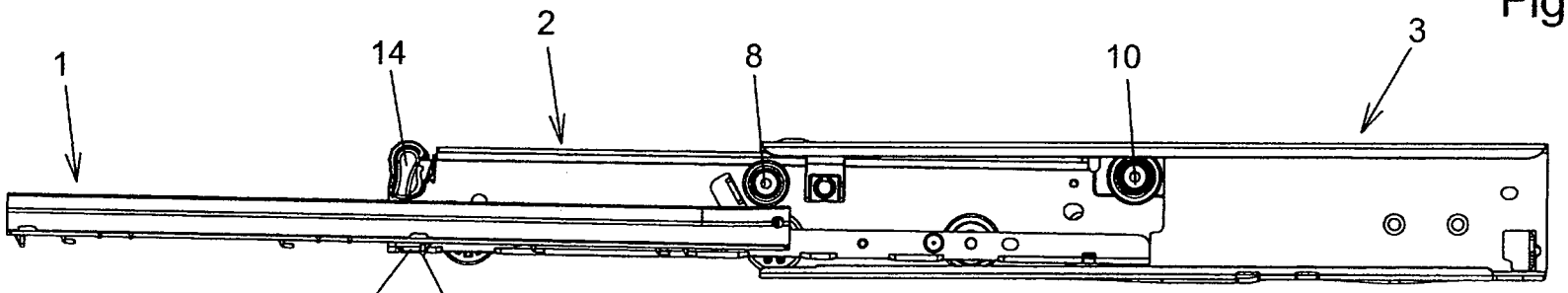
FIG. 18 shows a diagram similar to FIG. 17 in the open position of the pull-out guide.
Figure 19:
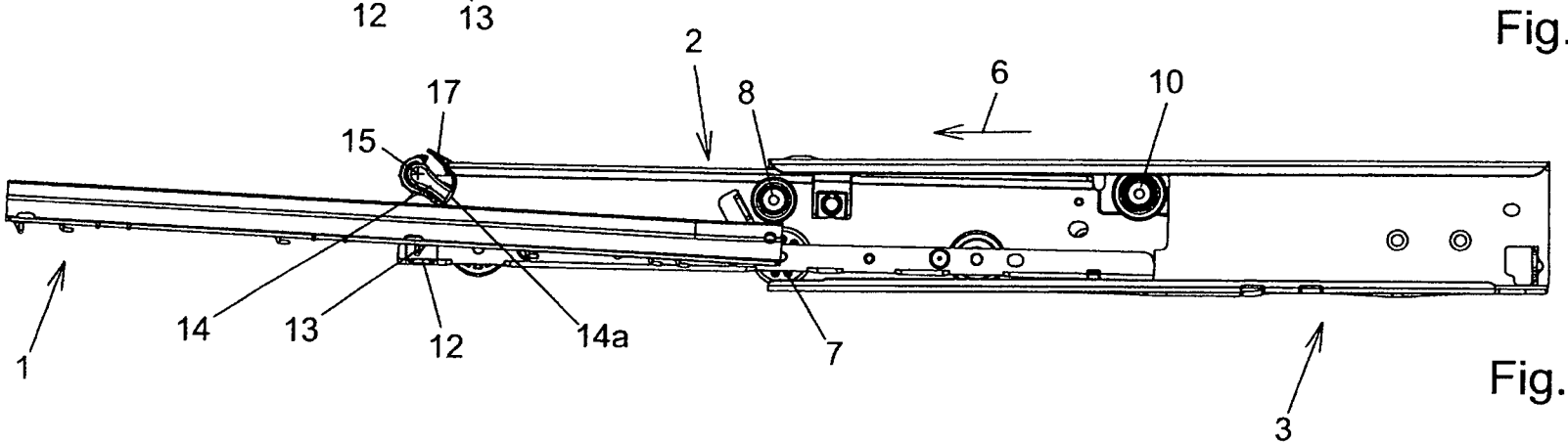
FIG. 19 shows a diagram similar to FIGS. 17 and 18 during removal of the first rail.

The complete removal of the first rail 1 starting from the closed position of the pull-out guide is explained by reference to FIGS. 17-19. If, starting from the closed position of the pull-out guide shown in FIG. 17, in which the first and second rail 1, 2 have their inserted position, the first rail 1 is pulled out and in so doing, at the same time the second rail 2 moves out from the third rail 3, the pulling out of the first rail 1 in the extracted position of the first and second rail 1, 2 is delimited by the stop element 13 of the first rail 1 striking the pull-out stop 12 of the second rail 2, as shown in FIG. 18. In order to enable the first rail 1 to hang out, the securing part 14 is twisted by the user from the blocked position into the release position wherein the snap connection snaps in between the securing part 14 and the second rail 2. The front end of the first rail 1 can now be raised and the stop element 13 can be moved over the pull-out stop 12 past this in the pull-out direction, cf. FIG. 19. The first rail 1 can now be completely removed from the second rail 2.

Figure 20:
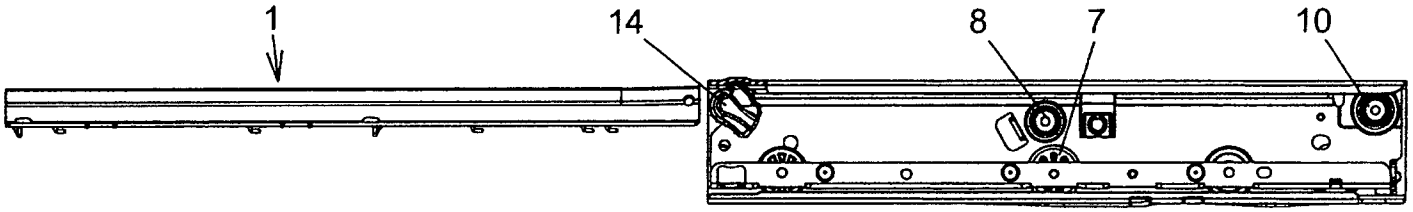
FIGS. 20 to 22 show side views of the pull-out guide during insertion of the first rail, wherein the third rail is cut in the region of the securing part.
Figure 21:
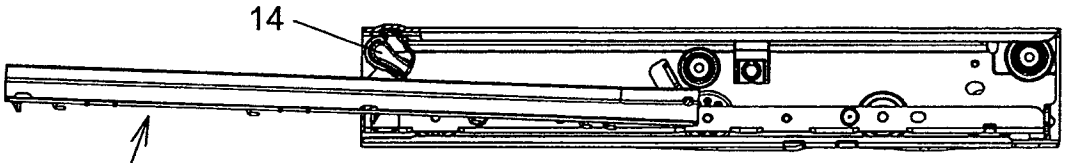
Figure 22:
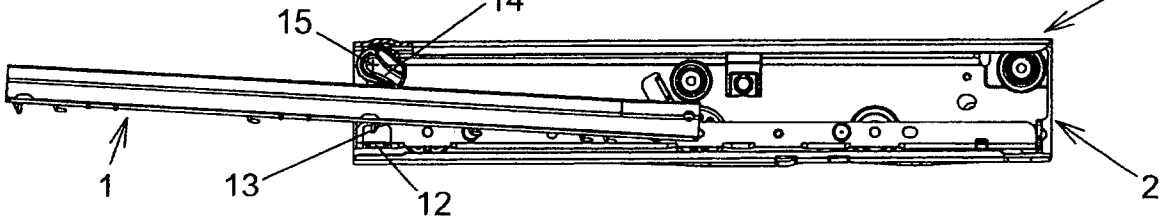
Figure 25:
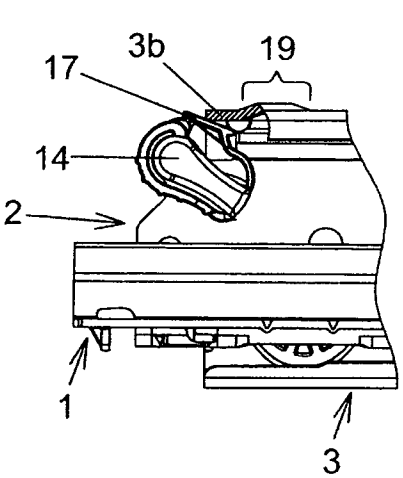
FIG. 25 shows a section of a front end portion of the pull-out guide during insertion of the first rail in the release position of the securing part during approach of the elastic tongue of the securing part to the third rail.
Figure 24:
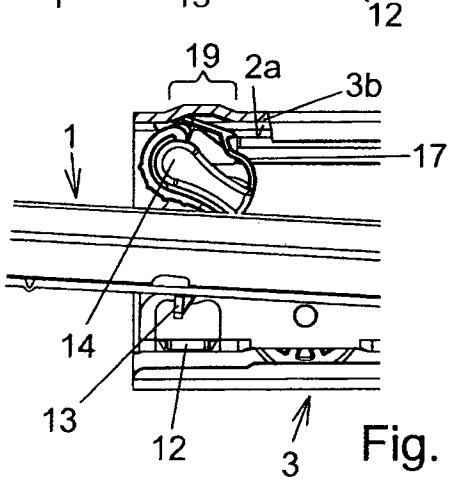
FIG. 24 shows an enlarged section from FIG. 22 in the region of the securing part.

Insertion of the first rail 1 completely removed from the second rail 2 into the second rail 2 is shown in FIGS. 20 to 22. When the first rail 1 is inserted into the second rail 2, the second rail 2 is preferably located in the inserted position in the third rail 3, cf. FIG. 20. In FIG. 20 the securing part 14 is shown before insertion of the first rail 1 in the release position. It can be brought into this position in advance by the user. In the region of its longitudinal extension in which the securing part 14 is located in the inserted position of the second rail 2, the upper horizontal web 3*b* of the third rail 3 has a clearance 19 for receiving the end portion of the elastic tongue 17, as can be seen in particular from FIG. 23. In the exemplary embodiment this clearance 19 is configured as an upward protrusion of the upper horizontal web 3*b*, whereby a receiving space is formed underneath this protrusion in the end portion of the elastic tongue 17 lies.

The first rail 1 can now be inserted into the second rail 2. For this purpose, the front end of the first rail 1 is raised, cf. FIG. 21, i.e. in the horizontal position of the second rail 2 the first rail 1 lies obliquely with respect to the horizontal. In this state, the stop element 13 can be moved past the pull-out stop 12 contrary to the pull-out direction 6. FIG. 21 specifically shows the state in which the rear end of the first rail 1 reaches the gap between the differential roller 7 and the support roller 8 located thereabove. If the first rail 1 in this position is inserted further into the gap between the differential roller 7 and the support roller 8, this has the result that the second rail 2 is raised somewhat with respect to the third rail 3 enlarging this gap between the differential roller 7 and the support roller 8 (the differential roller 7 has some play in the vertical direction). As a result, the free end of the elastic tongue 17 is pressed against the upper horizontal web 3*b* of the third rail 3 and the tongue 17 is bent, with the result that the locking tab 17 can come out of engagement with the retaining surface 2*a* of the second rail 2. This is in particular apparent from the enlarged section of FIG. 24. The snap connection is thus opened. When the front end of the first rail 1 is lowered after travel of the stop element 13 over the pull-out stop 12, the spring element 16 turns the securing part 14 about the axis of rotation 15 from the release position into the blocked position. The first rail 1 can further be inserted completely into the second rail 2 until it occupies the inserted position.

Figure 23:
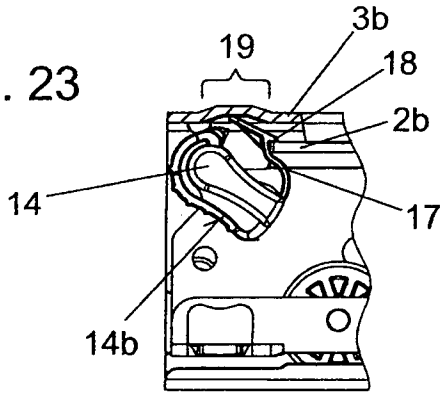
FIG. 23 shows an enlarged section from FIG. 20 in the region of the securing part.

Should the snap connection of the securing part 14 not have been opened during insertion of the first rail 1 into the second rail 2 (since the second rail 2 has not been raised sufficiently or the free end of the tongue 17 has not been or has not been pressed in sufficiently strongly), the snap connection is opened when the pull-out guide is pulled out from the closed position the next time. In the closed position of the pull-out guide, the second rail 2 and the third rail 3 and the securing part 14 located in the release position would occupy the state as shown in FIG. 23 (wherein in addition the first rail 1 would also be located in the inserted position). If during opening of the pull-out guide, the second rail 2 now moves with respect to the third rail 3 in the pull-out direction 6, in the region of the front end of the clearance 19 the free end of the resilient tongue 17 approaches the upper horizontal web 3*b* of the third rail 3 and is thereby pressed in. As a result of this pressing-in of the elastic tongue 17, the locking tab 18 is brought out of engagement with the retaining surface 2*a* and the snap connection is opened. The spring element 16 then twists the securing part 14 from the release position into the blocked position.

If, in the open position of the pull-out guide, i.e. when the first and second rail 1, 2 are located in the extracted positions, the securing part 14 should be located in the release position, during closure of the pull-out guide an opening of the snap connection takes place automatically and thus an adjustment of the securing part 14 from the release position into the blocked position. And specifically for this purpose, in the region of its free end shortly before reaching the inserted position of the second rail 2, the elastic tongue 17 approaches the front end of the upper horizontal web 3*b* of the third rail 3, cf. FIG. 25. The resilient tongue 17 is thereby pressed in and the locking tab 18 is brought out of engagement with the retaining surface 2*a*. The spring element 16 then turns the securing part 14 into the blocked position.

Figure 26:
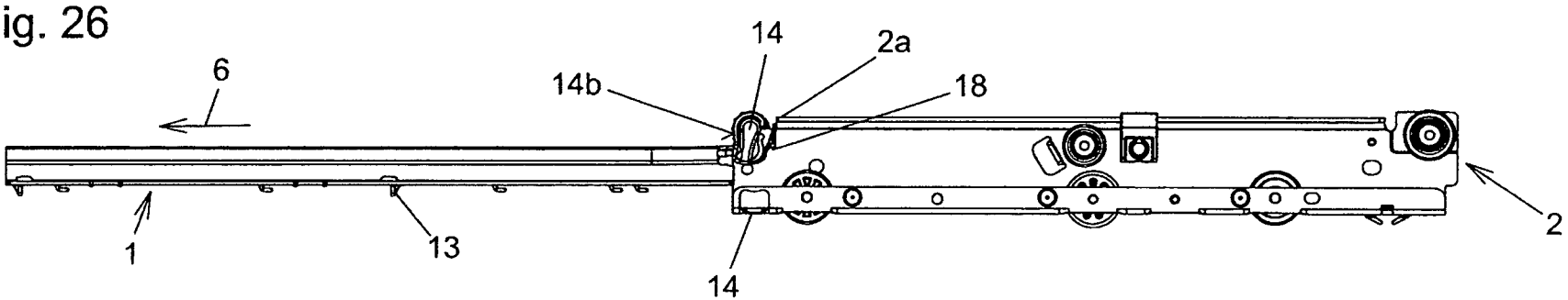
FIGS. 26 to 28 show side views during insertion of the first rail into the second rail when the securing part is initially in the blocked position.
Figure 27:
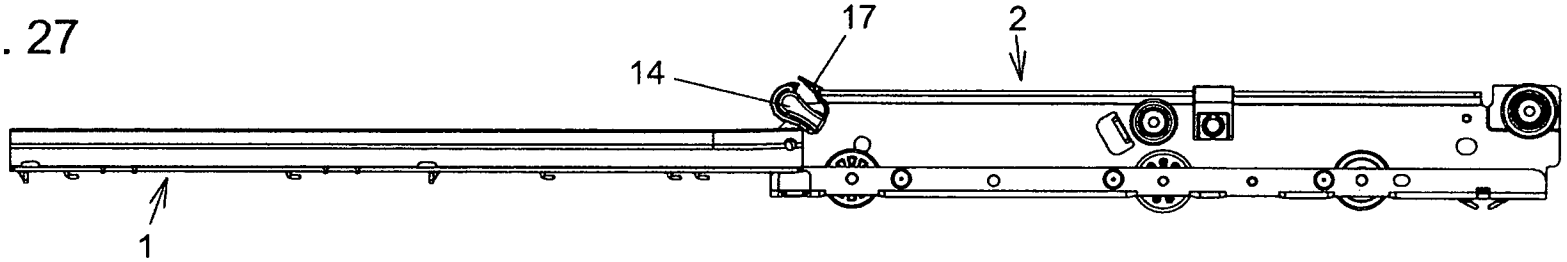
Figure 28:
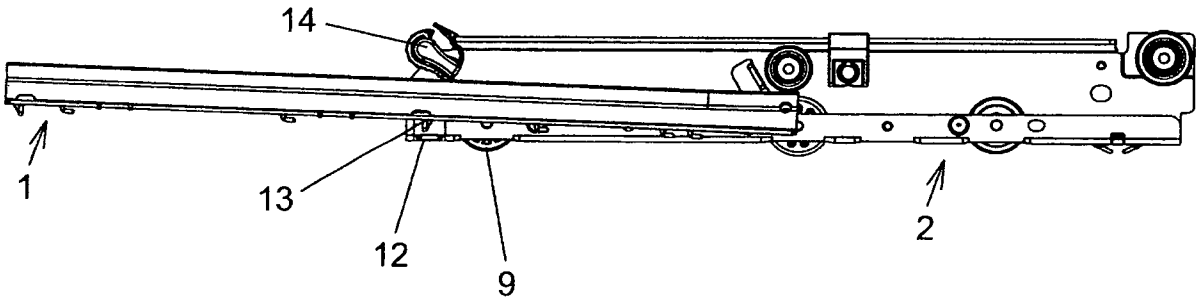

In the exemplary embodiment a manual twisting of the securing part 14 from the blocked position into the release position can be omitted for insertion of the first rail 1 into the second rail 2, as is explained with reference to FIG. 26 to 28. During insertion here the first rail 1 approaches the side surface 14*b* of the securing part 14 which points in the pull-out direction 6 in the blocked position of the securing part 14. This side surface 14*b* is configured to be indented and rippled with horizontally running indentations 20. The rear end of the first rail 1 thereby hooks into these structures of the side surface 14*b* and during insertion of the first rail 1 twists the securing part 14 into the release position in which the snap connection snaps in, cf. FIG. 27. Then as described previously the first rail 1 can be inserted into the second rail 2 with raised front end.

If an attempt is made to raise the first rail 1 in the blocked position of the securing part 14 with its front end, a force is applied to the stop surface 14*a* of the securing part 14 which acts at least substantially perpendicularly upwards. As a result of the position of the contact surface 14*a* relative to the axis of rotation 15, a force acting perpendicularly upwards on the contact surface 14*a* results in a torque applied to the securing part 14 which acts contrary to the opening direction of rotation. It could also be said that the securing part 14 in the blocked position in relation to the support surface 1*b* of the first rail 1 has been twisted over the dead point contrary to the opening direction about the axis of rotation 15. In this case, a stop 14*c* of the securing part is pressed against a stop surface 2*c* arranged on the second rail 2 (indicated in FIG. 11), with the result that this torque is supported. The spring element 16 therefore does not need to hold the securing part 14 in the blocked position with such a force acting on the securing part 14.

Figure 16:
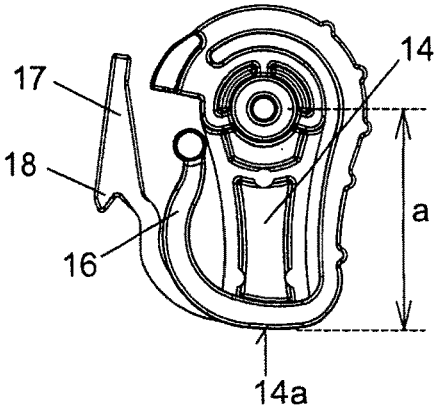
FIGS. 15 and 16 show a front and rear view of the securing part.
Figure 15:
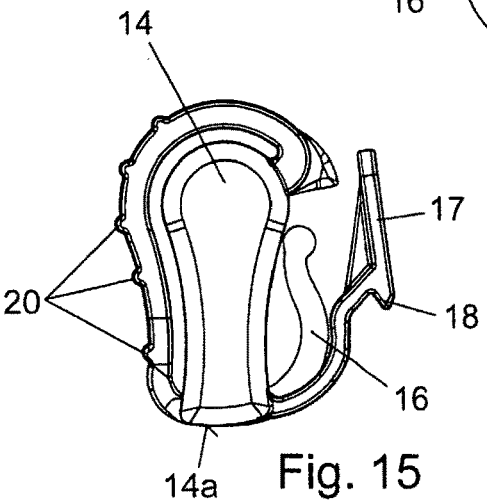
Figure 14:
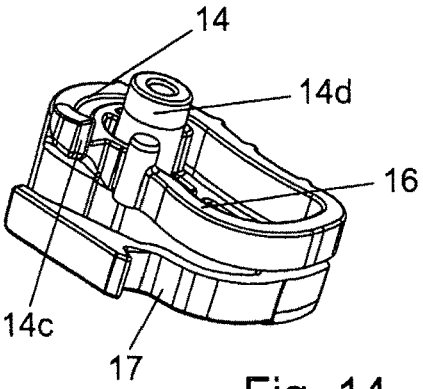

For rotatable connection of the securing part 14 to the main part of the second rail 2, in the exemplary embodiment an axle pin 14*d* of the securing part 14 is inserted through an opening in the main part of the second rail and staked. FIGS. 14 to 16 show the axle pin 14*d* as it is configured before insertion of the securing part 14 and staking. The staked end of the axle pin 14*d* can be seen in FIG. 7.

Instead, a twistable connection of the securing part 14 with the main part of the second rail 2 could be made in a different manner, for example by riveting or screwing.

Various modifications of the exemplary embodiment described are feasible and possible without departing from the scope of the invention as defined in the claims.

For example, the clearance 19 could also comprise an opening in the upper horizontal web 3*b* of the third rail 3 or be formed overall by such an opening.

The snap connection between the securing part 14 and the second rail 2 could also be formed in a different manner. It would fundamentally also be feasible and possible that an elastic snap element is disposed on the second rail 2 which snaps into a contact surface 14*a* of the securing part 14 in the release position of the securing part 14.

Instead of a snap connection a holding device configured in a different manner could also be provided which, in a holding state, holds the securing part twisted into the release position in the release position and preferably automatically adopts the holding state during twisting of the securing part from the blocked position into the release position. For this purpose, for example, a spring element initially counteracts a twisting of the securing part 14 from the blocked position in the direction of the release position could be brought over a dead point so that in the release position of the securing part the spring element exerts a torque on the securing part which acts in the opening direction of rotation and presses a stop of the securing part against a counter-stop of the second rail.

The pull-out guide could fundamentally be configured in a different manner than in the form of a differential pull-out guide. Thus, it could also be provided that the pull-out guide comprises only a first rail and a second rail, wherein the second rail is to be attached to the furniture carcass and could also be designated as carcass rail and the first rail is to be attached to the extractable furniture part and could also be designated as pull-out rail.

REFERENCE LIST

1 First rail
1*a* Track

1*b* Support surface
1*c* Horizontal web
2 Second rail
2*a* Retaining surface
2*b* Upper horizontal web
2*c* Stop surface
3 Third rail
3*a* Track
3*b* Upper horizontal web
4 Furniture carcass
5 Extractable furniture part
6 Pull-out direction
7 Differential roller
8 Support roller
9 Roller
10 Roller
11 Auxiliary roller
12 Pull-out stop
13 Stop element
14 Securing part
14*a* Contact surface
14*b* Side surface
14*c* Stop
14*d* Axle pin
15 Axis of rotation
16 Spring element
17 Tongue
18 Locking tab
19 Clearance
20 Indentation

The invention claimed is:

1. A pull-out guide for pulling out an extractable furniture part (5) from a furniture carcass (4), comprising: a first rail (1) and a second rail (2), wherein the first rail (1) is configured to be pulled out from the second rail (2) in a pull-out direction (6) from an inserted position into an extracted position in which a further pulling out of the first rail (1) from the second rail (2) is delimited by a stop element (13) of the first rail (1) striking a pull-out stop (12) of the second rail (2), and wherein a securing part (14) is mounted on the second rail (2) so as to be rotatable about an axis of rotation (15), wherein the securing part is configured to be twisted counter to a force of a spring element (16) from a blocked position, in which a lifting of a front end of the first rail (1) is blocked, into a release position in which the front end of the first rail (1) can be lifted and the stop element (13) of the first rail (1) can be moved over the pull-out stop (12) of the second rail (2) for complete removal of the first rail (1) from the second rail (2), and wherein a holding device is provided which, in a holding state, holds the securing part (14) twisted into the release position.

2. The pull-out guide according to claim 1, wherein the holding device is configured to automatically adopt the holding state during a twisting of the securing part from the blocked position into the release position.

3. The pull-out guide according to claim 2, wherein the holding device is configured as a snap connection.

4. The pull-out guide according to claim 3, wherein, in order to form the snap connection, the securing part (14) has an elastic tongue (17) which has a locking tab (18) which, in the holding state of the holding device, cooperates with a retaining surface (2*a*) disposed on the second rail (2).

5. The pull-out guide according to claim 1, comprising a third rail (3), wherein the second rail (2) can be pulled out in the pull-out direction (6) from the third rail (3) from an inserted position into an extracted position, wherein in the inserted position of the first and second rail (1, 2), a closed position of the pull-out guide exists and in the extracted position of the first and second rail (1, 2), an open position of the pull-out guide exists, and wherein, during movement of the first rail (1) with the second rail (2) the second rail (2) moves synchronously with respect to the third rail (3).

6. The pull-out guide according to claim 5, further comprising a load-transmitting differential roller (7) rotatably mounted in a central region of a longitudinal extension of the second rail (2), which rolls between a track (1*a*) of the first rail (1) and a track (3*a*) of the third rail (3).

7. The pull-out guide according to claim 3, comprising a third rail (3), wherein the second rail (2) can be pulled out in the pull-out direction (6) from the third rail (3) from an inserted position into an extracted position, wherein in the inserted position of the first and second rail (1, 2), a closed position of the pull-out guide exists and in the extracted position of the first and second rail (1, 2), an open position of the pull-out guide exists and wherein during movement of the first rail (1) with the second rail (2) the second rail (2) moves synchronously with respect to the third rail (3), and wherein, during insertion of the second rail (2) into the third rail (3) starting from a state in which the second rail (2) is located in the extracted position and the securing part (14) is located in the release position, a section of the third rail (3) opens the snap connection, and wherein the spring element (16) twists the securing part (14) into the blocked position.

8. The pull-out guide according to claim 7, wherein a section of the third rail (3) opens the snap connection during insertion of the second rail (2) into the third rail (3) from a state in which the second rail (2) is located in the extracted position and the securing part (14) is located in the release position, wherein the spring element (16) twists the securing part (14) into the blocked position, and wherein during insertion of the second rail (2) into the third rail (3) from a state in which the second rail (2) is located in the extracted position and in which the securing part (14) is located in the release position, an elastic tongue of the securing part approaches a front end of an upper horizontal web (3*b*) of the third rail (3) and opens the snap connection.

9. The pull-out guide according to claim 4, comprising a third rail (3), wherein the second rail (2) can be pulled out in the pull-out direction (6) from the third rail (3) starting from an inserted position into an extracted position, wherein in the inserted position of the first and second rail (1, 2) a closed position of the pull-out guide exists and in the extracted position of the first and second rail (1, 2) an open position of the pull-out guide exists and wherein during movement of the first rail (1) with the second rail (2) the second rail (2) moves synchronously with respect to the third rail (3), and wherein an upper horizontal web (3*b*) of the third rail (3) has a clearance (19) which in the inserted position of the second rail (2) and in the release position of the securing part (14) receives at least an end portion of the elastic tongue (17) of the securing part (14).

10. The pull-out guide according to claim 9, wherein, during extraction of the second rail (2) from the third rail (3) starting from a state in which the second rail (2) is located in the inserted position and the securing part (14) is located in the release position, a free end of the elastic tongue (17) approaches the upper horizontal web (3*b*) of the third rail (3) and opens the snap connection, wherein the spring element (16) twists the securing part (14) into the blocked position.

11. The pull-out guide according to claim 10, wherein the second rail (2) has a rotatably mounted load-transmitting differential roller (7) in a central region of its longitudinal extension which rolls between a track (1*a*) of the first rail (1)

and a track (3*a*) of the third rail (3), and wherein during insertion of a rear end of the first rail (1) between the differential roller (7) and a support roller (8), the first rail (1) is lifted and a free end of the elastic tongue (17) is pressed against the upper horizontal web (3*b*) of the third rail (3) and the snap connection is opened.

12. The pull-out guide according to claim 1, wherein the spring element (16) has a curved shape, and wherein the spring element (16) and the securing part (14) are configured in one piece, and wherein an end of the spring element (16) that is remote from the securing part (14) is supported on the second rail (2).

13. The pull-out guide according to claim 1, wherein the securing part (14) comprises a contact surface (14*a*), and wherein the first rail (1) comprises a support surface (1*b*), wherein the support surface (1*b*) is configured to abut the contact surface (14*a*) of the securing part (14) in the blocked position to block lifting of the front end of the first rail (1), wherein the securing part (14) in a side view seen in a direction parallel to the axis of rotation (15) has an external contour.

14. The pull-out guide according to claim 1, wherein, during insertion of a removed first rail (1) into the second rail (2) from a rear end of the first rail (1), the securing part (14) located in the blocked position can be twisted into the release position.

* * * * *